US007429165B2

(12) United States Patent
Burdgick et al.

(10) Patent No.: US 7,429,165 B2
(45) Date of Patent: Sep. 30, 2008

(54) HYBRID BLADE FOR A STEAM TURBINE

(75) Inventors: Steven Sebastian Burdgick, Schenectady, NY (US); Wendy Wen-Ling Lin, Niskayuna, NY (US); Adegboyega Makinde, Niskayuna, NY (US); Christophe Lanaud, Delanson, NY (US); Amitabh Bansal, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 365 days.

(21) Appl. No.: 11/452,336

(22) Filed: Jun. 14, 2006

(65) Prior Publication Data

US 2007/0292274 A1 Dec. 20, 2007

(51) Int. Cl.
*F01D 5/28* (2006.01)

(52) U.S. Cl. ..... 416/229 A; 416/230

(58) Field of Classification Search ..... 416/229 A, 416/223 A

See application file for complete search history.

(56) References Cited

U.S. PATENT DOCUMENTS 4,957,410 A 9/1990 Silvestri, Jr.
5,720,597 A 2/1998 Wang et al.
5,791,879 A 8/1998 Fitzgerald et al.
5,931,641 A 8/1999 Finn et al.
6,042,338 A 3/2000 Brafford et al.
6,139,278 A 10/2000 Mowbray et al.
6,364,616 B1 * 4/2002 Stevenson et al. ..... 416/229 A
6,375,417 B1 4/2002 Hofer et al.
6,854,959 B2 2/2005 Barb
2006/0024169 A1 2/2006 Burdgick et al.
2006/0029501 A1 2/2006 Burdgick et al.

OTHER PUBLICATIONS

U.S. Appl. No. 11/452,403, filed Jun. 14, 2006.

* cited by examiner

*Primary Examiner*—Richard Edgar
(74) *Attorney, Agent, or Firm*—Nixon & Vanderhye PC

(57) ABSTRACT

To address certain deficiencies of carbon fiber material as a filler in a hybrid blade, a glass composite layer is provided as a barrier layer between a carbon fiber resin filler and the metallic main body of the blade. The glass composite layer also advantageously provides a gradient in thermal expansion between the carbon fiber composite and the body of the blade (steel) to reduce interfacial residual stress.

20 Claims, 5 Drawing Sheets

HYBRID BLADE FOR A STEAM TURBINE

BACKGROUND OF THE INVENTION

The present invention relates generally to gas and steam turbines and, more particularly, to a steam turbine blade composed of two or more components made from different materials.

Steam turbine blades operate in an environment where they are subject to high centrifugal loads and vibratory stresses. Vibratory stresses increase when blade natural frequencies become in resonance with running speed or other passing frequencies (upstream bucket or nozzle count, or other major per/rev features). The magnitude of vibratory stresses when a blade vibrates in resonance is proportional to the amount of damping present in the system (damping is comprised of material, aerodynamic and mechanical components, as well as the vibration stimulus level). For continuously coupled blades, the frequency of vibration is a function of the entire system of blades in a row, and not necessarily that of individual blades within the row.

Furthermore, for turbine buckets or blades, centrifugal loads are a function of the operating speed, the mass of the blade, and the radius from engine centerline where that mass is located. As the mass of the blade increases, the physical area or cross-sectional area must increase at lower radial heights to be able to carry the mass above it without exceeding the allowable stresses for the given material. This increasing section area of the blade at lower spans contributes to excessive flow blockage at the root and thus lower performance. The weight of the blade contributes to higher disk stresses and thus to potentially reduced reliability.

Several prior U.S. patents/applications relate to so-called "hybrid" blade designs where the weight of the airfoil is reduced by composing the airfoil as a combination of a metal and polymer filler material. Specifically, one or more pockets are formed in the airfoil portion and filled with the polymer filler material. These prior patents/applications include U.S. Pat. Nos. 6,854,959; 6,364,616; 6,139,278; 6,042,338; 5,931,641 and 5,720,597; application Ser. No. 10/900,222 filed Jul. 28, 2004 and application Ser. No. 10/913,407 filed Aug. 7, 2004; the disclosures of each of which are incorporated herein by this reference.

BRIEF DESCRIPTION OF THE INVENTION

The invention provides a metallic bucket (or blade) with a recessed pocket or a through wall window that contains a composite filler. In an example embodiment, the composite filler is a carbon fiber composite. Further, in an example embodiment, a glass fiber (fabric) barrier interface is provided between the carbon composite and the metallic blade.

Thus, the invention is embodied in steam turbine blade comprising: an airfoil portion having an operating temperature range, a design rotational speed, a blade root, a blade tip, and a radial axis extending outward toward said blade tip and inward toward said blade root, and wherein said airfoil portion is comprised of: (1) a metallic section consisting essentially of metal and having a first mass density, wherein said metallic section radially extends from generally said blade root to generally said blade tip; and (2) at least one fiber composite section, having a second mass density less than said first mass density; wherein said fiber composite section is comprised of a carbon fiber composite and a glass barrier layer interposed between said carbon fiber composite and said metallic section.

The invention may further be embodied in a gas turbine engine having a rotating component with a plurality of blades extending therefrom, said plurality of blades comprising: at least one first blade type defining a first blade group, each first blade in said first blade group having a first resonant frequency; at least one second blade type defining a second blade group, each second blade in said second blade group having a second resonant frequency that differs from said first resonant frequency, wherein said first blade type is comprised of: an airfoil portion having an operating temperature range, a design rotational speed, a blade root, a blade tip, and a radial axis extending outward toward said blade tip and inward toward said blade root, and wherein said airfoil portion is comprised of: (1) a metallic section consisting essentially of metal and having a first mass density, wherein said metallic section radially extends from generally said blade root to generally said blade tip; and (2) at least one fiber composite section, having a second mass density less than said first mass density; wherein said fiber composite section is comprised of a carbon fiber composite and a glass barrier layer interposed between said carbon fiber composite and said metallic section.

The invention may also be embodied in a steam turbine blade comprising: a) a steam-turbine-blade shank portion; b) a steam-turbine-blade metallic airfoil portion attached to said shank portion and having a pressure side and a suction side, wherein at least one of said pressure and suction sides includes at least one recess, wherein said at least one recess has a void volume; and c) filler material disposed in and bonded to said at least one recess and generally completely filling said void volume, wherein said filler material as a whole has a lower average mass density than that of said metallic airfoil portion as a whole, wherein said filler material is comprised of a carbon fiber composite and a glass barrier layer interposed between said carbon fiber composite and said metallic airfoil portion.

DETAILED DESCRIPTION OF THE INVENTION

Figure 1:
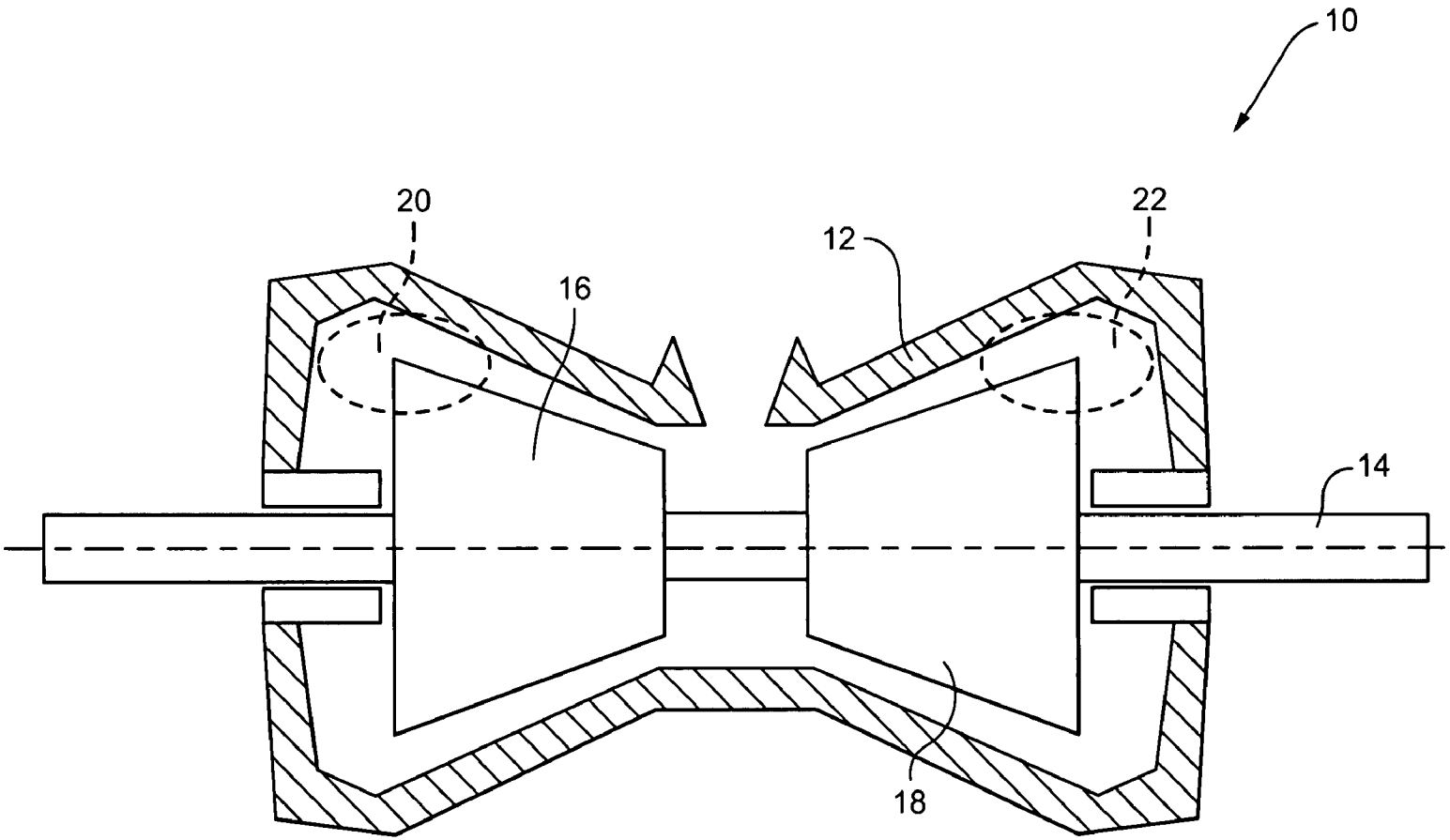
FIG. 1 is a schematic diagram of a double-flow low pressure turbine.

FIG. 1 is a schematic diagram of a double-flow, low pressure turbine 10 including a turbine casing 12, rotor 14 and a plurality of wheels in two turbine sections indicated at 16, 18. The areas 20, 22 circled in dotted lines represent the radially outermost regions of the last stage blades that have been shown to experience the most windage heating during partial load conditions.

Figure 2:
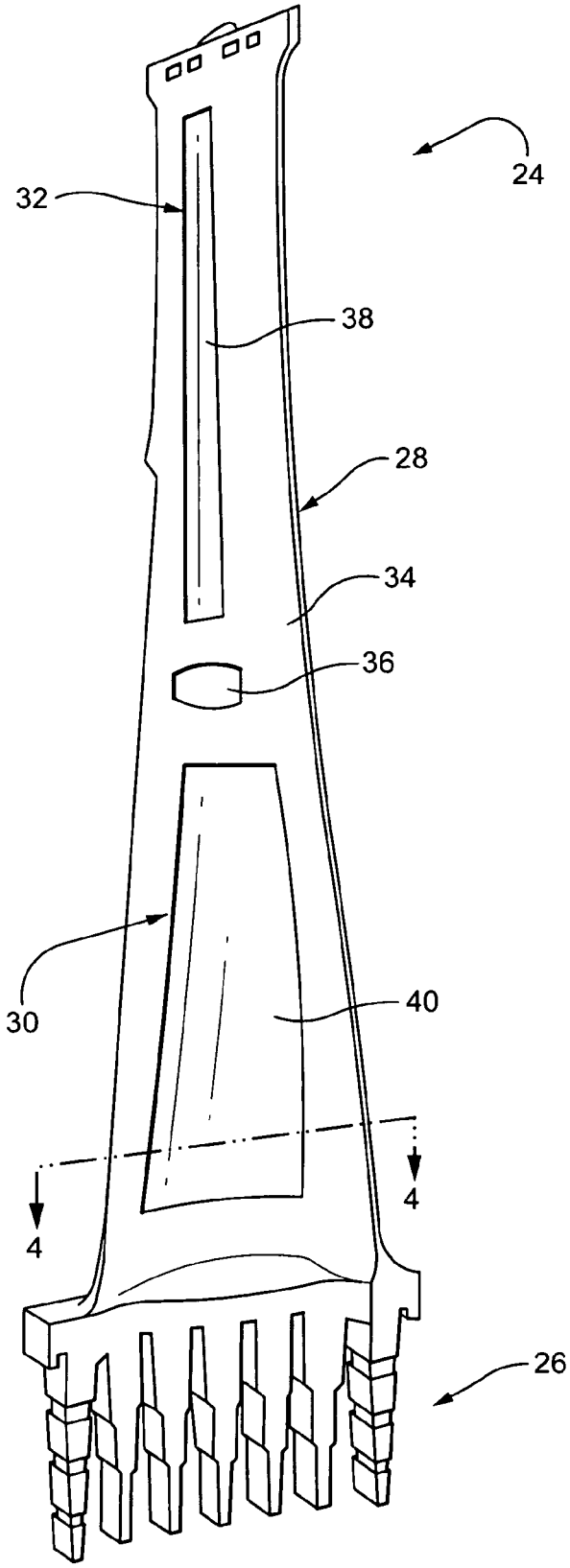
FIG. 2 is a schematic illustration of a partially completed hybrid blade.
Figure 3:
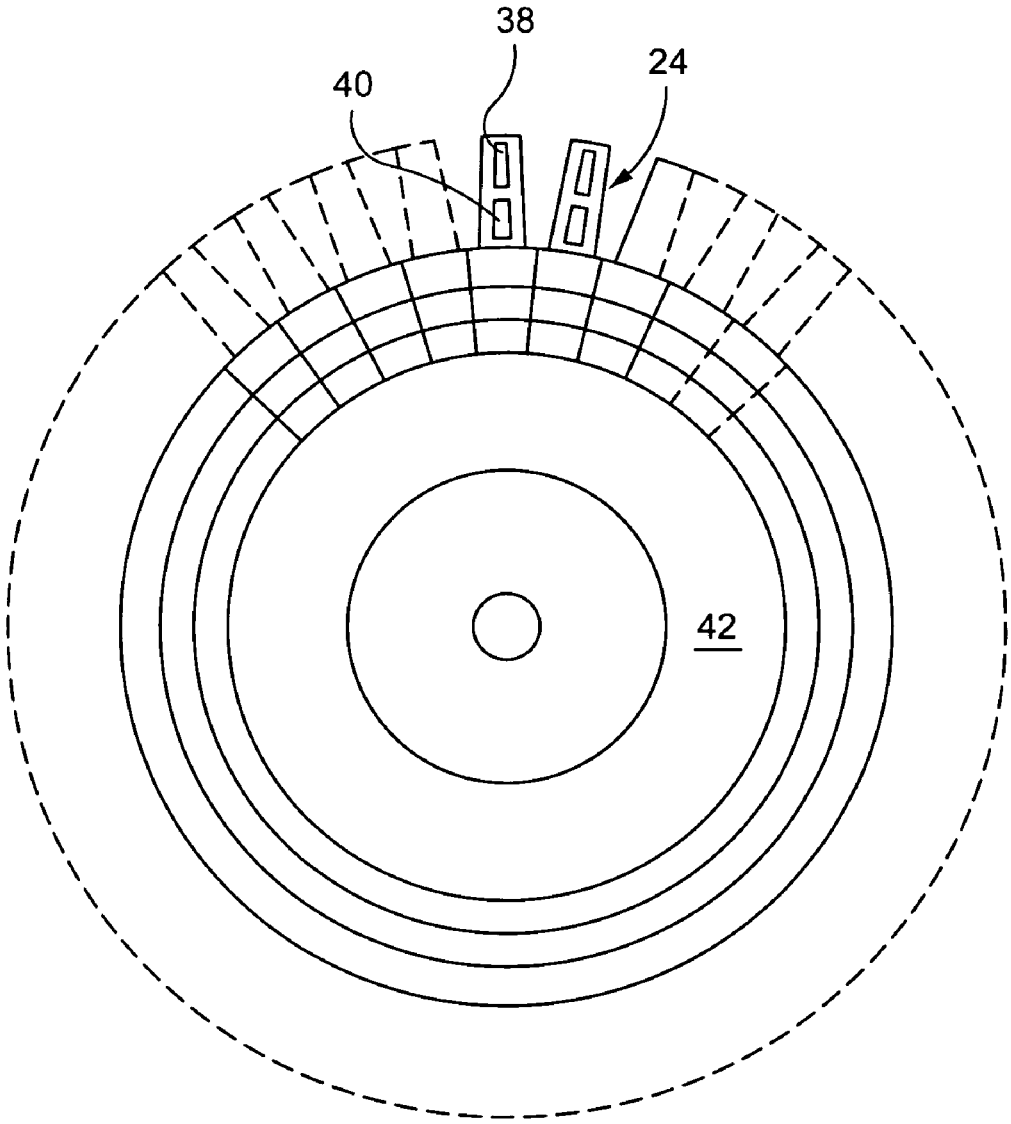
FIG. 3 is a schematic side elevation of a turbine wheel having a plurality of turbine blades mounted thereon.

FIG. 2 schematically shows an example construction of a steam turbine blade 24 in which the invention may be embodied. The steam turbine blade includes a shank portion 26 and an airfoil portion 28. The airfoil portion has an operating temperature range, a design rotational speed, a blade root attached to the shank portion, a blade tip, and a radial axis extending outward toward the blade tip and inward toward the blade root. The shank portion typically includes a dovetail for attachment of the blade to a rotor disc (FIG. 3), and a blade platform for helping to radially contain the steam flow. The airfoil portion has a leading edge and a trailing edge, with the steam flow direction generally being from the leading edge to the trailing edge. The airfoil also has a pressure side and suction (convex) side. In the illustrated example, radially inner and outer pockets 30, 32 are formed on the pressure side of the airfoil portion 28, separated by a relatively wide web or rib and a mid-span damper 36. More (or fewer) pockets can be included in the blade design. FIG. 3 illustrates schematically a row of hybrid blades 24, mounted on a turbine rotor wheel 42, as discussed further below.

The airfoil includes a main body or section 34 consisting essentially of metal. In this regard, the term "metal" includes "alloy" but for the purposes of describing the invention herein is not considered to mean a "metallic foam". In the example embodiment described herein, the main body is a monolithic metallic section, although the invention is not necessarily limited in this regard. The metallic section has a first mass density and radially extends from generally the blade root to the blade tip. The pockets or recesses 30, 32 are defined in the airfoil where the metal is omitted or removed. In this regard, the main body or metallic section 34 of the blade is forged, extruded or cast, and the pockets or recesses 30, 32 may be formed by machining such as, for example, by chemical milling, electrochemical machining, water-jet milling, electro-discharge machining or high speed machining.

Figure 4:
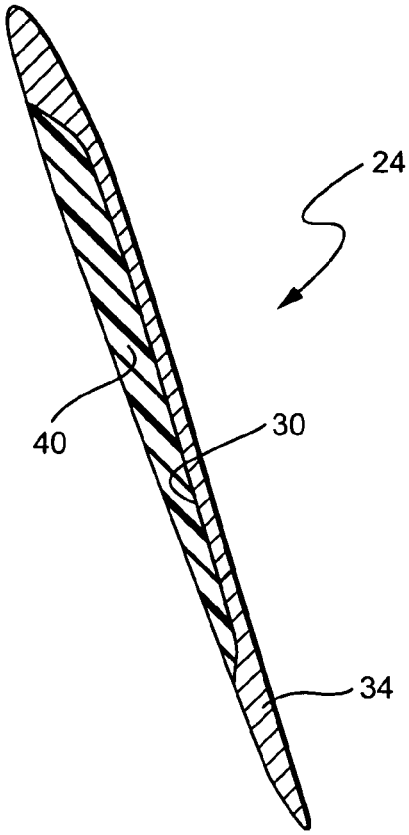
FIG. 4 (Prior Art)
FIG. 4 is a cross-sectional view taken along line 4-4 of FIG. 2.

FIG. 4 is a cross-section depiction of the FIG. 2 hybrid blade structure, wherein a filler section 40 that does not consist essentially of metal and that has a second mass density, different from the first mass density, is provided in a pocket 30 of the metal section. Some suitable filler compositions are disclosed, for example, in U.S. Pat. Nos. 6,287,080 and 5,931,641, the disclosures of each of which are incorporated herein by this reference.

If deemed necessary or desirable, the filler section 38 disposed to fill pocket 32 may have different properties, such as temperature resistance, as compared to the filler section 40 used to fill pocket 30. The utilization of different filler sections, or more specifically filler materials, permits improved temperature capability of hybrid blades at reduced cost. Each material used could be formulated for specific locations on the blade based on temperature characteristics of the filler materials and temperature capability requirements of the blades in any given stage. Using the more expensive, high temperature, materials in a limited location on the blade makes the design of hybrid blades more feasible especially for those blades that experience high windage conditions, i.e. in the region 20, 22 of the last stage(s).

Choices for bonding the filler materials to the metal surface of the airfoil portion 28 include, without limitation, self adhesion, adhesion between the filler materials and the metal surface of the airfoil portion 28, adhesive bonding (adhesive film or paste), and fusion bonding.

Hybrid bucket (or blade) design allows for several beneficial outcomes in that it creates a lighter blade which allows for longer or wider cord buckets. However, typical hybrid blade designs do not have a stiff enough composite material in the pocket to help strengthen the blade. Thus, conventionally, the amount of pocketing (depth) in a hybrid blade has been limited due to stress limitations. This limits the ability to create longer, wider or tuned buckets (blades). Overcoming this limitation of conventional hybrid blade design would be advantageous.

Using a carbon fiber material as the filler material in a hybrid blade is beneficial as it can be stiffer than the metallic blade section, thereby allowing a more aggressive pocketing of the blade while keeping the blade mechanically robust. Thus, using a stiff carbon composite can help reduce the stress level in the blade outer area as it makes up for metal that has been removed. However, the inventors have recognized that the interface between the metallic section and the carbon composite can cause galvanic corrosion that would degrade the strength and efficiency of the metallic section over time. Additionally, interfacial stresses are caused by the large mismatch in thermal expansion between the carbon fiber composite, which can be as low as 0.01 ppm/° F., and e.g. steel, which is typically 7 ppm/° F.

Thus, in example embodiments of the invention, the filler material in a hybrid blade is comprised of a carbon fiber lay-up, with resin, and a glass type fiber interface (barrier) that is provided at least between the metallic blade material and the carbon composite. In this regard, the glass composite layers provide a dual benefit of serving as a barrier between the metal of the blade and the carbon composite filler, and of reducing the interfacial stresses between these thermally mismatched components. Further in this regard, the glass composite interlayer coefficient of expansion can be tuned by controlling fiber orientation as well as fiber fraction.

Thus, the use of a carbon composite as proposed herein above is stiff enough to overcome stress limitations, so as to allow for more aggressive pocketing, and the provision of a glass fiber (fabric) barrier interface interposed between the carbon composite and the metallic main body protects the metal from galvanic corrosion and reduces interfacial residual stress.

In some situations, the carbon and steam interface may also need to be protected since carbon may not be as robust in a steam environment. In this regard, there is some evidence that steam and carbon may not always be compatible. Thus, if deemed necessary or desirable, the glass composite can also be used as an erosion shield or barrier between the carbon and the steam environment. Thus, according to yet a further, optional feature of example embodiments of the invention, the glass barrier layer can also be used as a protective cover layer for the steam path facing surface(s) of the carbon fiber composite. However, the glass composite cover does not necessarily need to be used on the steam path surface(s).

Figure 5:
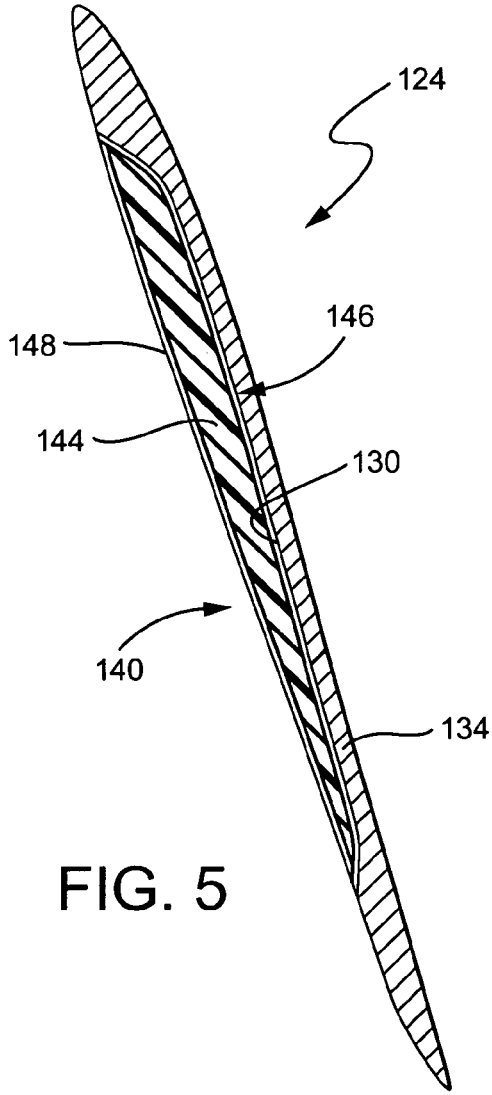
FIG. 5 is a cross-sectional view similar to FIG. 4 illustrating a hybrid blade with glass barrier according to an example embodiment of the invention.

FIG. 5 schematically illustrates an example embodiment of the invention wherein a filler section 140 comprised of a carbon fiber lay-up 144 is disposed in a pocket 130 formed in the airfoil main body 134. As is also illustrated in FIG. 5, a glass fiber layer 146 is disposed between the metallic blade main body and the carbon fiber filler 144. FIG. 5 also schematically depicts the optional use of a glass composite layer 148 as an interface between the steam environment and the carbon fiber filler material 144. This lay-up could also use the different fiber orientations between each layer to specifically "tune" the airfoil frequency, or to "mis-tune" the bucket set as described below.

As described in greater detail below, to further reduce the weight of the blade in example embodiments of the invention the pocket or portion(s) thereof may be defined to extend entirely through the blade as one or more windows to the opposite, suction side of the blade. The pocket and/or window is then filled with a composite material to reestablish the original airfoil shape or design airfoil shape.

Figure 6:
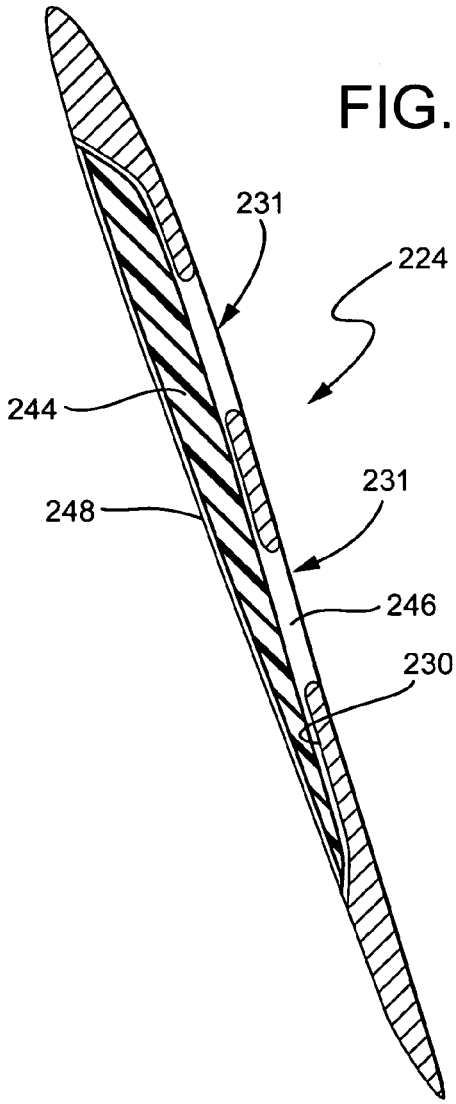
FIG. 6 is a cross-sectional view similar to FIG. 5 depicting a hybrid blade with glass barrier including windows on the convex side.

Thus, the embodiment of FIG. 6 is similar to the embodiment of FIG. 5 except in that the pocket comprises window(s) 231 defined to extend from the base of a shallow pocket portion 230, through the blade main body to the suction side of the airfoil 224. Thus, in this embodiment the window(s) 231 each have a width in the widthwise direction of the blade that is less than the width of the shallow pocket portion 230. In the illustrated example, the glass barrier material 246 fills the windows 231 themselves with the carbon fiber filler material 244 being confined to the shallow pocket portion 230. The window(s) 231 not only further reduce the weight of the blade structure 224, but are meant to assist in reducing the shear stress between the composite 244 and metallic blade at their interface. The FIG. 6 embodiment also schematically depicts the optional use of a glass composite layer 248 as an interface between the steam environment and the carbon fiber filler material 244.

Figure 7:
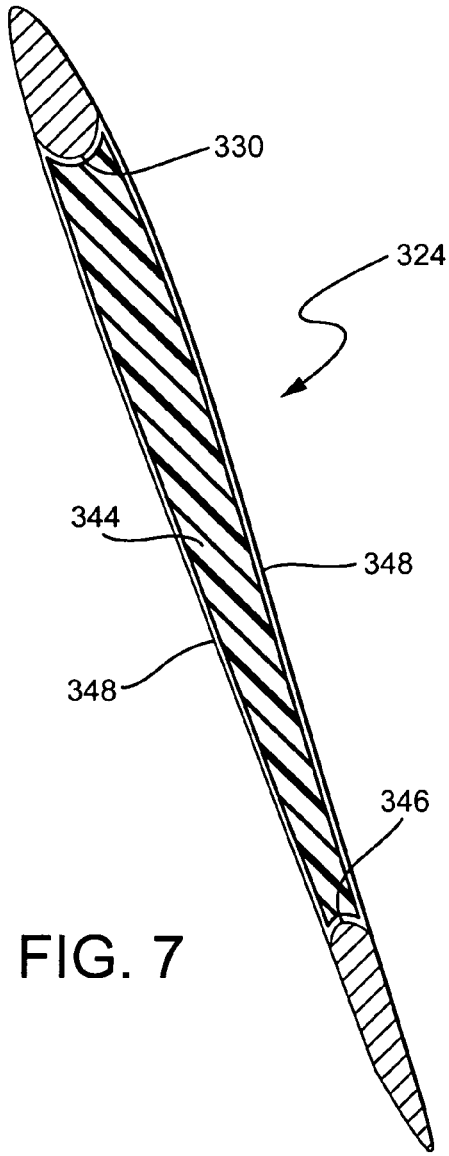
FIG. 7 is a cross-sectional view of a further example embodiment of the invention with filler material disposed in a through window.

FIG. 7 illustrates yet a further example embodiment of the invention wherein the pocket 330 again comprises a window is defined in the main body of the blade 324. Thus, in this embodiment the window has a width corresponding to that of the pocket. The window or through pocket 330 is filled with the carbon fiber composite material 344. Furthermore, at the junction between the filler material and the body of the airfoil, peripherally of the window, a barrier 346 of glass fibers (with resin matrix) is provided. In the illustrated example, the glass barrier layer is also disposed to extend, as at 348, between the stiff carbon material 344 and the steam path. As noted above, without the use of a stiff carbon material, it would not be possible for the pocket to be defined as a through pocket 330 completely through the blade wall. Using carbon fibers 344 with the glass interface 346, 348 as disclosed herein thus provides a significant potential to further reduce the weight of the blade near the outer regions of the airfoil.

The invention further provides a means of suppressing the aerodynamic elastic response of a blade row (continuously coupled or free-standing) by facilitating mixed-tuning of the natural frequency within the row. Mixed-tuning would comprise combining a particular segment of buckets with one frequency characteristic, with one or more other groups of another frequency. The buckets are then selectively assembled in a row so as to achieve improved mechanical damping of a system. There may be more than one group of blades depending on the desired end result.

In this regard, by varying the amount of carbon 144, 244, 344 versus glass barrier fibers 146, 148; 246, 248; 346, 348 in the pockets/windows 130; 230, 231; 330 one can predictably vary the stiffness of the blade 124, 224, 324. This can be accomplished by altering the number of layers of carbon fibers versus the glass barrier fibers; more carbon to stiffen individual buckets and less carbon to allow for more flexibility. This change in stiffness typically correlates to a change in natural frequency. Buckets of varying frequency characteristics (stiffness) can be combined to alter the natural frequency of the bucket group. Thus, a plurality of blades may be provided, each with the same aerodynamic shape and profile externally, but with different filler sections to create at least two distinct groups of blades, one group could use a high strength or stiffer material while the other group could use a lower stiffness or higher damping material. Thus, using this concept two or more populations of blades may be purposefully manufactured and logically assembled so as to utilize their inherent difference in natural frequency as a means of damping the system response to synchronize and non-synchronize vibration without adversely affecting the aerodynamic properties of the blade design.

Thus, the blades 124, 224, 324 described above may be utilized to form a row of blades on a steam turbine rotor wheel as illustrated in FIG. 3. Specifically, groups A and B may be assembled on the turbine wheel in a predetermined mapped configuration for example, in the pattern ABAB . . . , such that a blade of group A is always adjacent a blade of group B. In this way, the two (or more) populations of blades maybe purposefully manufactured and logically assembled so as to utilize their inherent differences in resonance frequencies as a means of reducing the system response to synchronous and non-synchronous vibrations, without adversely affecting the aerodynamic properties of the blade design. Further in this regard, there exists the potential to design one group of blades where the natural frequency is equally disposed between two "per-rev" criteria (4 per rev and 5 per rev split for example), and to design the other group of blades with a different filler section, so as to be equally disposed about another set of "per-rev" stimuli (such as a 3 per rev and 4 per rev split).

It is also possible to vary the pattern of blade group distribution, again so as to achieve the desired frequency characteristics. For example, a pattern AABBAA . . . or AABAA B . . . might also be employed. The mapped configuration results in mixed tuning of the set of blades via various damping responses of the blades in each group of blades to create a more damped blade row or set. This may also shift the frequencies of each blade to take even greater advantage of the mixed tuning concept.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine blade comprising:

an airfoil portion having an operating temperature range, a design rotational speed, a blade root, a blade tip, and a radial axis extending outward toward said blade tip and inward toward said blade root, and wherein said airfoil portion is comprised of:

(1) a metallic section consisting essentially of metal and having a first mass density, wherein said metallic section radially extends from generally said blade root to generally said blade tip; and (2) at least one fiber composite section, having a second mass density less than said first mass density;

wherein said fiber composite section is comprised of a carbon fiber composite and a glass barrier layer interposed between said carbon fiber composite and said metallic section.

2. The steam turbine blade of claim 1, wherein said metallic section and said at least one carbon fiber composite section together define a generally airfoil shape at said design rotational speed.

3. The steam turbine blade of claim 1, wherein said carbon fiber composite comprises at least one layer of carbon fiber material/fabric with resin.

4. The steam turbine blade of claim 1, wherein said glass barrier layer comprises a glass fiber layer with resin between the metallic blade and the carbon fiber composite.

5. The steam turbine blade of claim 1, wherein said carbon fiber composite section is disposed in a pocket defined in a pressure side of said metallic section.

6. The steam turbine blade of claim 5, wherein said pocket comprises at least one window defined through said metallic section to a convex, suction side of said metallic section.

7. The steam turbine blade of claim 6, wherein window has a width, in a widthwise direction of said blade, that is less than a width of said pocket.

8. The steam turbine blade of claim 7, wherein said pocket further comprises a shallow pocket portion and wherein said at least one window extends from a base of said shallow pocket portion to said suction side.

9. The steam turbine blade of claim 8, wherein said glass barrier layer is disposed to substantially fill said at least one window.

10. The steam turbine blade of claim 1, wherein said fiber composite section is disposed in a through pocket defined through said metallic section from one surface thereof to an opposite surface thereof.

11. The steam turbine blade of claim 1, further comprising a glass barrier layer overlying and covering steam path facing surfaces of said carbon composite material.

12. A gas turbine engine having a rotating component with a plurality of blades extending therefrom, said plurality of blades comprising:

at least one first blade type defining a first blade group, each first blade in said first blade group having a first resonant frequency;

at least one second blade type defining a second blade group, each second blade in said second blade group having a second resonant frequency that differs from said first resonant frequency, wherein said first blade type is comprised of:

an airfoil portion having an operating temperature range, a design rotational speed, a blade root, a blade tip, and a radial axis extending outward toward said blade tip and inward toward said blade root, and wherein said airfoil portion is comprised of:

(1) a metallic section consisting essentially of metal and having a first mass density, wherein said metallic section radially extends from generally said blade root to generally said blade tip; and (2) at least one fiber composite section, having a second mass density less than said first mass density;

wherein said fiber composite section is comprised of a carbon fiber composite and a glass barrier layer interposed between said carbon fiber composite and said metallic section.

13. A gas turbine engine as in claim 12, comprising a plurality of first blade groups and a plurality of second blade groups, and wherein the first and second blade groups are alternatingly disposed adjacent one another about said rotating component.

14. A gas turbine engine as in claim 13, wherein at least one of said first and second blade groups has only a single blade, so that a single blade of said one of said first and second blade groups is disposed between blades of said other of said first and second blade groups.

15. A steam turbine blade comprising:

a) a steam-turbine-blade shank portion;

b) a steam-turbine-blade metallic airfoil portion attached to said shank portion and having a pressure side and a suction side, wherein at least one of said pressure and suction sides includes at least one recess, wherein said at least one recess has a void volume; and c) filler material disposed in and bonded to said at least one recess and generally completely filling said void volume, wherein said filler material as a whole has a lower average mass density than that of said metallic airfoil portion as a whole, wherein said filler material is comprised of a carbon fiber composite and a glass barrier layer interposed between said carbon fiber composite and said metallic airfoil portion.

16. The steam turbine blade of claim 15, wherein said carbon fiber composite comprises at least one layer of carbon fiber material/fabric with resin.

17. The steam turbine blade of claim 15, wherein said recess comprises at least one window defined through said metallic portion.

18. The steam turbine blade of claim 17, wherein said recess further comprises a shallow pocket portion and wherein said at least one window extends from a base of said shallow pocket portion through said metallic airfoil portion.

19. The steam turbine blade of claim 18, wherein said glass barrier layer is disposed to substantially fill said at least one window.

20. The steam turbine blade of claim 15, further comprising a glass barrier layer overlying and covering steam path facing surfaces of said carbon composite material.

* * * * *